United States Patent [19]

Adkins

[11] Patent Number: 4,753,042

[45] Date of Patent: Jun. 28, 1988

[54] MAGNETIC WEATHER STRIP FOR DOOR

[76] Inventor: Kyle Adkins, 12372 Devoe, Southgate, Mich. 48195

[21] Appl. No.: 70,054

[22] Filed: Jul. 6, 1987

[51] Int. Cl.[4] ..... E06B 7/16

[52] U.S. Cl. ..... 49/478; 400/485

[58] Field of Search ..... 49/478, 485, 400, 401, 49/489

[56] References Cited

U.S. PATENT DOCUMENTS

| | | | |
|---|---|---|---|
| 2,959,832 | 11/1960 | Baermann | 49/478 X |
| 3,140,517 | 7/1964 | Richter | 49/489 |
| 3,411,243 | 11/1968 | Baermann | 49/485 X |
| 3,469,349 | 9/1969 | Multer | 49/478 |
| 3,512,304 | 5/1970 | Meuret | 49/478 X |
| 4,006,562 | 2/1977 | Belanger et al. | 49/489 X |
| 4,490,943 | 1/1985 | McLaughlin | 49/478 |

*Primary Examiner*—Philip C. Kannan

*Attorney, Agent, or Firm*—Cullen, Sloman, Cantor, Grauer, Scott & Rutherford

[57] ABSTRACT

A magnetic weather strip for sealing a door within a frame comprises a pre-bent thin iron based resilient metal strip of L shape extending along the sides and top edge of the door and secured thereto. A wood strip is mounted upon the frame along the sides and top of the door and has a compressible resilient filler mounted along its length and interlocked therewith. An elongated magnetic strip is embedded within the filler opposed to the metal strip, with the filler in yieldable sealing engagement with the metal strip when the door is closed, and the metal strip attracted to the magnetic strip.

14 Claims, 1 Drawing Sheet

MAGNETIC WEATHER STRIP FOR DOOR

FIELD OF THE INVENTION

The invention relates to magnetic weather stripping for a door in a frame and more particularly to a metal strip of L shape extending along the sides and top of the door and secured thereto. A wood strip is mounted and secured upon the frame opposing the metal strip and a solid compressible resilient filler is mounted and secured along the wood strip with a magnetic strip embedded therein.

BACKGROUND OF THE INVENTION

Previously there exists the problem of properly sealing peripheral edge portions of the door within a door frame for keeping cold air out and warm air upon the interior of a building. Heretofore various types of magnetic weather stripping have been employed wherein a metal strip and a magnetic strip respectively mounted upon the door and upon the frame co-act to provide a seal along the sides and top of the door relative to the frame. Additionally, efforts have been made to seal the bottom of the door with respect to a door threshold.

Devices of this type have been costly, difficult to assemble and difficult to use, and inefficient for the intended purposes of preventing escape of warm air from the interior of a building and the entrance of cold air from its exterior.

PRIOR ART

Illustrative of prior art efforts to accomplish sealing of portions of the door with respective portions of the frame are the following U.S. Pat. Nos.:

2,959,832: M. BAERMAN: Nov. 15, 1960
3,133,324: P. FOREMAN: May 19, 1964
3,238,573: D. H. PEASE, JR.: Mar. 8, 1966
3,241.198: M. BAERMANN: Mar. 22, 1966
3,512,304: H. C. MEURET: May 19, 1970
3,604,152: J. M. PROTZMAN: Sept. 14, 1971
4,192,101: W. G. WHITE: Mar. 11, 1980
4,463,523: MAILAND et al: Aug. 7, 1984
4,490,943: McLAUGHLIN: Jan. 1, 1985

Various deficiencies are found in the disclosures of the foregoing patents, particularly the difficulty of making the magnetic weather stripping, and the difficulty of assembling the respective parts upon the door and door frame, and the need for special tools for separately securing the respective parts on the door and frame.

Baermann 2,959,832, FIG. 6, magnetic strip 12 is backed by rubber plate 13 which is attached to a door 10. The purpose of the rubber plate 13 is to cushion the magnetic strip when it closes upon the magnetic strip 11 attached to the door jamb, so as to equalize any unevenness in the spacing of the door as it closes.

Bearmann 3,241,198 discloses a number of arrangements for securing elongated, flexible magnets into resilient gaskets for providing atmospheric seals around the periphery of refrigerator doors, but the arrangements are acknowledged to have applications for securing the doors of various structures.

Foreman discloses a magnetic weather seal for a window which will permit position control of the upper and lower windows without the need for slide bolts, spring-loaded pins, and other such devices. The magnetic strip 40 is disclosed as being pliable, relatively flexible, and formed by extrusion of a polyvinyl stock containing an Indox material which may be magnetized permanently (see FIG. 6).

Pease, Jr., discloses weather stripping for use with steel-faced door. The magnetic element of the weather stripping 10 is designed to be fastened to a door frame during its manufacture but is thereafter adjustable to compensate for ordinary errors in alignment. Pease, Jr., teaches providing the weather stripping with a certain degree of "reach" so that the magnetic element will reach out and engage the door even if the door is not fully closed. As can be seen in FIG. 2, an extending foot 19 has a flexible portion that functions as a hinge for the magnetic element.

Protzman 3,604,152 and Meuret 3,512,304 both show sealing assemblies with bellows spacing elements.

White 4,192,101 discloses a door sealing apparatus that includes a thin ferrous metal strip 12, carried on the face of the door along its periphery, and a sealing strip 14 (see FIG. 5) having a mounting base 15, a bellows member 17, and a magnetic portion 18 in which a magnetic bar is permanently molded. A special construction is provided for the threshold which is shown in FIGS. 2 and 6.

Mailand discloses a weather strip assembly for sealing the space between a door and a threshold. Referring to FIG. 1 of the patent, a strip 16 is shown to have a flexible portion 20 and a stiff portion 17. The stiff portion 17 is adapted to be adhered to the vertical surface of the door by means shown in FIG. 4, with the flexible portion 20 extending below the bottom edge of the door and along a threshold 14. A magnetic strip 26, shown in both FIGS. 1 and 4, is attached to the flexible portion 20 and a metal strip 27 is adapted to be adhered to the surface of the threshold by means showing in FIG. 5. The strips are face-to-face to effect a releasable seal between the door and the threashold when the door is closed.

McLaughlin discloses a magnetic strip seal for doors intended for use in residential housing. The particular contribution that McLaughlin makes to the art of using magnetic weather stripping for door seals is that it teaches a condensation-resistant, metal-and-polymer, bellows-type door seal which may be conveniently retrofitted to existing doors. In FIG. 1 the bellows member 14 extends from an aluminum mounting flange 12 to a sleeve 18 in which a magnetic rod 16 is inserted. The magnet 16 is attracted to a strip magnet 22 mounted on the door 24 to seal off any opening between the door and the door frame when the door is closed.

SUMMARY OF THE INVENTION

An important feature of the present invention relates to a magnetic weather stripping for a door hinged within a frame which includes a pre-stressed metal strip of L shape extending along the sides and top of the door and secured thereto. A wood strip is mounted and secured upon the frame opposing the metal strip and a solid compressible resilient filler is mounted along and secured to the wood strip with a magnetic strip embedded therein along it length.

As another feature, the weather stripping includes a pre-bent thin iron based resilient metal strip of general L shape in crosssection which extends along the sides and top edge of the door with the short leg of the strip snugly engaging the door edge and with a long leg adjacent the frame extending along the inner surface of the door and secured thereto.

As another feature, a wood strip of rectangular cross-section is mounted upon the frame along the sides and top of the door and secured to the frame and spaced from the door. A compressible filler of a resilient material, as for example rubber or plastic, is mounted upon and along the length of the wood strip and is longitudinally interlocked therewith.

As another feature, an elongated magnetic strip is embedded and enclosed within the compressible filler and is arranged adjacent and parallel to the metal strip with the filler in sealing engagement with the door when fully closed within the door opening and with the metal strip attracted to the magnetic strip.

Still another feature is to provide the angle between the legs of the metal strip less than 90° and with the short leg being stressed outwardly to a 90° snug engagement with the door when the long leg is mounted along the door face and secured thereto. The preferred angle is in the range of 84° to 86°.

As another feature, the securing of the metal strip to the door includes a series of longitudinally spaced pre-punched openings formed in the long leg of the strip and a series of fasteners projected through the openings and into the door, the metal strip being first stressed into snug engagement with the door.

Still another feature is to provide the interlock of the filler with respect to wood strip as a continuous interconnected dovetail and dovetail slot.

As a further feature, the securing of the wood strip to the frame includes a series of longitudinally spaced transverse apertures pre-formed within the strip, and wherein a series of fasteners extend through the apertures and into the frame.

Another feature is to provide a portion of the longitudinal surface of the filler upon the hinger side of the frame adjacent the door cut away to provide a clearance angle of 6°, approximately, relative to the door edge.

Still another feature is to provide a kit for providing magnetic weather stripping for a door within an opening within a frame which includes the pre-bent thin iron based resilient metal strip of L shape. The wood strip of rectangular cross-section is mounted upon the frame along the sides and top of the door and secured to the frame. A solid compressible filler of resilient plastic material, such as rubber or plastic is mounted along the wood strip and longitudinally interlocked therewith along its length with the filler extending outwardly of the frame and in compressive yielding engagement with the metal strip. An elongated magnetic strip is embedded and enclosed within the compressible filler adjacent to the metal strip. The kit includes at least three (3) pre-bent metal strips with pre-punched openings along their lengths, three (3) wood strips with assembled compression fillers and with a magnetic strip embedded in each filler and with the wood strip having pre-cut longitudinally spaced openings therein. Each of the respective strips are oversize in length to accomodate doors of different height and width. The kit further includes a plurality of fasteners for securing the respective strips to the door and frame.

These and other objects and features will be seen in the following specification and claims in conjunction with the accompanying drawing.

THE DRAWING

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Figure 1:
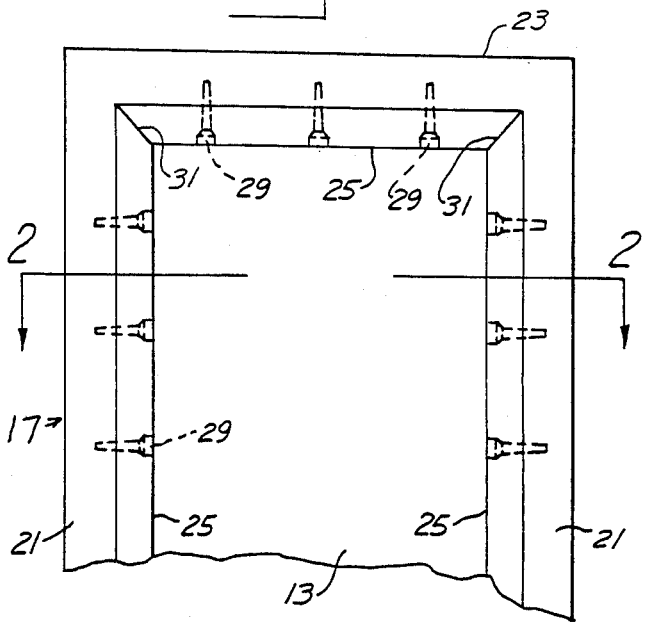
FIG. 1 is a fragmentary elevational view from the inside of a frame of a door mounted therein with the present weather stripping assembled.
Figure 2:
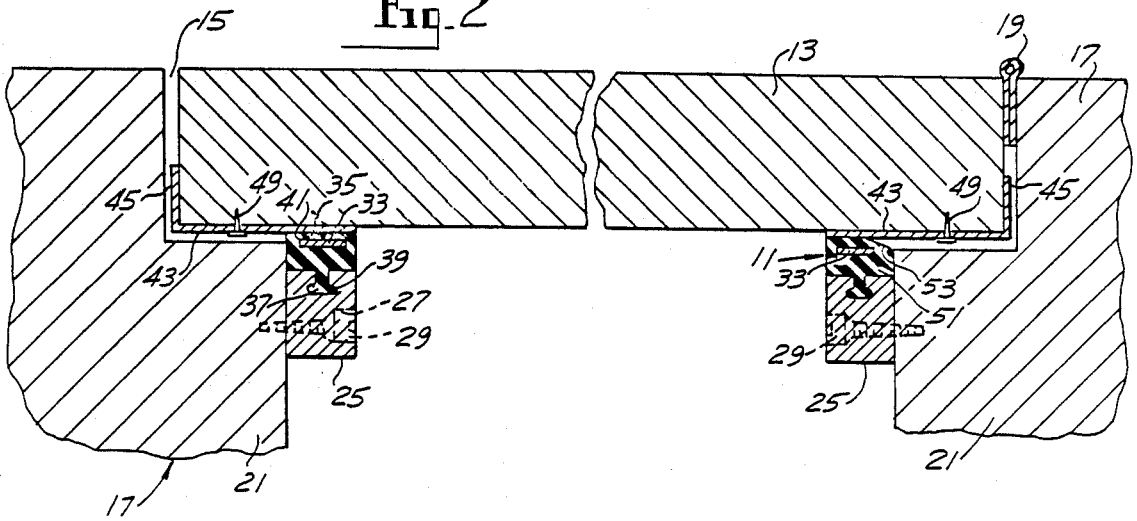
FIG. 2 is a fragmentary plan section taken in the direction of arrows 2—2 of FIG. 1, on an increased scale.

Referring to the drawings, FIGS. 1 through 4, the present magnetic weather strip for a door is designated at 11 in FIG. 2, the dor fragmentarily shown at 13 within door opening 15 within frame 17, fragmentarily shown. The door is hinged to the frame along one upright edge at 19. The door within the frame is fragmentarily shown in FIG. 1. The present magnetic weather strip is shown assembled, and extends along styles 21 and top rail 23 of the frame and is secured thereto.

In the illustrative embodiment and forming a part of the magnetic weather stripping for the door shown in FIG. 2, there is provided an elongated wood strip 25 which extends along opposite sides of the door and adjacent the top thereof, is rectangular in cross-section, and includes a series of pre-drilled transverse apertures 27 adapted to receive fasteners 29 which extend into frame 17.

In the assembly of the respective wood strips 25 upon the sides and top portions of the frame relative to corresponding portions of door 13 the meeting connections between right angularly related strips are mitered at 31, FIG. 1.

An elongated magnetic strip 33 is embedded, or molded or otherwise enclosed within an elongated compression strip 35 of resilient material such as rubber, or sponge rubber, or a resilient plastic material, FIG. 2. The compressible filler strip 35 is mounted upon and along wood strip 25 and is longitudinally interlocked therewith by the cooperating interlocked dovetail 37 and corresponding dovetail slot 39.

In the illustrative embodiment the dovetail slot 39 is initial formed along the length of wood strip 25. The corresponding dovetail 37 is molded or formed as a part of compression strip 35 and snugly projects along the length of dovetail slot 39. This provides the longitudinal interlock between the compression strip of rubber or resilient plastic material and said wood strip.

Arranged upon and along the sides and top of door 13 is the elongated pre-bent thin iron based resilient metal strip 43 in registry with the resilient door engaging surface 41 of compressible filler 35.

Figure 3:
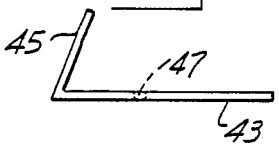
FIG. 3 is an end view of the metal strip as mounted along the door edges as shown in FIG. 2.

In the illustrative embodiment the short leg 45 of metal strip 43, FIG. 3, is arranged at an acute angle less than 90° with respect to the long leg of said strip. While this angle ranges between 84° and 86°, in the preferred embodiment the angle is 86°, for illustration.

Figure 4:
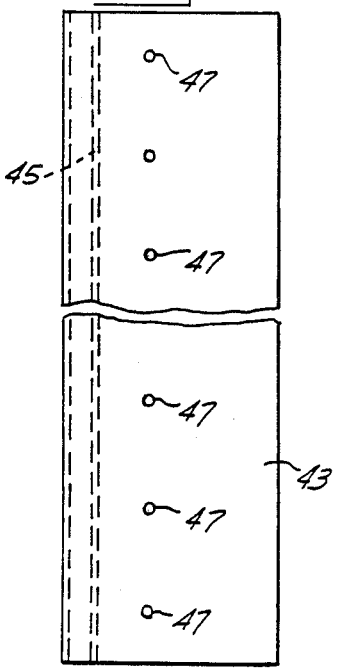
FIG. 4 is a front elevational view of the metal strip shown in FIGS. 2 and 3 upon a reduced scale.

A series of longitudinally spaced pre-punched apertures 47 are formed through the long leg of the pre-bent thin iron based strip 43, FIG. 4, and are adapted to receive corresponding fasteners 49 which extend through apertures and into door 13.

In the assembly of the L shaped strip along the corresponding side and top edges of the door, the strip is first stressed against the door so that the short leg 45 is at an angle of 90° with respect to the long leg, snugly bares against the corresponding edge of the door and is retained thereon under tension after the long leg has been secured to the door by the series of fasteners 49 which extend through apertures 47, FIG. 4.

A modified compression strip 51 is shown in FIG. 2 mounted upon frame 17 adjacent the hinged upright edge of door 13. The outer longitudinal surface 53 is arranged at a clearance angle of 6°, approximately, with respect to door 13 to facilitate closing of the door to the position shown in FIG. 2 and without unnecessary interference of the compression strip to such closing.

In accordance with the present invention there is provided a kit which includes at least three strips of the pre-bent thin iron based resilient metal strip 43 of general L shape, at least three wood strips 25 with the compression filler of resilient material of rubber or other resilient plastic material as at 35 and with a magnetic strip 33 embedded along its length. The respective strips 43 and 25 have pre-formed therethrough corresponding longitudinally spaced apertures 47 and 27 adapted to receive as a part of the kit a series of fasteners 49 and 29.

In the illustrative embodiment the respective strips 43 and 25, including the compression filler 35 are of an oversize length in order to fit doors of different heights and widths. All that is required for the purchaser of such a kit is to measure the height of door opening 15 within frame 17 as well as the width of the smaller frame opening, cut the respective strips 43 and 25 to the proper length and including the miter joint 31, if desired for an improved assembly, in FIG. 1.

As a first step the respective thin metal strips 43 are pre-stressed so that the short leg 45 is at 90° to the long leg of the strip, assembled over the door edge and secured thereto by a series of fasteners 49.

After the wood strip with the assembled compression filler 35 is cut to the proper length and mitered at 31 it is mounted along the corresponding inner surfaces of the frame which define the inner frame opening or passage way leading to door 13. The strips are secured in position by the series of fasteners 29 which extend through the strips and into the adjacent frame 17.

In this assembly the corresponding compressible fillers 35 extend into snug yielding engagement with door 13 when closed within the opening 15. The magnetic strip 33 is closely adjacent and opposed to metal strip 43, being embedded within compressible filler 35. With the door fully closed within opening 15 the compressible filler 35 is in yielding and sealing engagement with the door along its sides and top portions. At the same time the corresponding portions of strip 43 are magnetically attracted to magnetic strips 33 embedded within compression filler 35.

The respective metal and wood strips are pre-punched with the apertures therein and with the kit includes the necessary amount of fasteners, and a few extra. Anyone with limited knowledge as to the use of a mitering saw and a hammer can make the assembly shown in FIG. 2. The respective fasteners 29, FIGS. 1 and 2, and fasteners 49, FIG. 2, are assembled with respect to the corresponding pre-punched apertures 47 and 29 so as to be flush with the outer surface of the respective strips.

In the preferred embodiment the compressible filler 35 is formed of a rubber material which is molded or otherwise formed so as to embed and enclose therein elongated magnetic strip 33 FIG. 2. Said filler is yieldable and extends into door opening 15 so that it will respond to any unevenness or warping of the door and continuously register therewith along it height and width.

Having described my invention reference should now be had to the following claims.

I claim:

1. A magnetic weather strip for sealing a door within an opening in a frame comprising a pre-bent thin iron based resilient metal strip of general L shape in cross-section, extending along the sides and top edge of the door, with the short leg of the strip snugly engaging the door edge and with the long leg adjacent said frame extending along the inside surface of the door and secured thereto;

a wood strip of rectangular cross-section mounted upon the frame along the sides and top of the door secured to said frame and spaced from said door;

a compressible filler of resilient plastic material mounted upon and along said wood strip and longitudinally interlocked therewith along its length, said filler extending outwardly of the frame and in compressive yielding engagement with said metal strip along its length; and an elongated magnetic strip embedded and enclosed within said compressible filler adjacent and parallel to said metal strip, with said filler in sealing engagement with said door when fully closed within said opening and with said metal strip attracted to said magnetic strip.

2. In the weather strip of claim 1, the angle between the legs of said metal strip being less than 90°, the short leg being stressed outwardly to a 90° snug engagement with the door when the long leg is secured thereto.

3. In the weather strip of claim 2, said angle being 86°.

4. In the weather strip of claim 2, said angle being 84° to 86°.

5. In the weather strip of claim 4, the securing of said metal strip to said door including a series of longitudinally spaced pre-punched openings in the long leg of said strip; and fasteners projected through said openings into said door, with said metal strip first stressed into snug engagement with the door.

6. In the weather strip of claim 1, the securing of said metal strip to said door including a series of longitudinally spaced pre-punched openings in the long leg of said strip; and fasteners projected through said openings into said door, with said metal strip first stressed into snug engagement with the door.

7. In the weather strip of claim 1, said filler being rubber.

8. In the weather strip of claim 1, said filler being a resilient plastic material.

9. In the weather strip of claim 1, the interlock of said filler comprising a continuous interconnected dovetail and dovetail slot between said filler and said wood strip.

10. In the weather strip of claim 1, said interlock of said filler including a continuous dovetail slot formed along the length of said wood strip and a continuous dovetail projecting along the length of said filler longitudinally nested and retained within said dovetail slot.

11. In the weather strip of claim 1, the securing of said wood strip to said frame including a series of longitudinally spaced transverse apertures in said strip; and fasteners extending through said apertures and into said frame.

12. In the weather strip of claim 1, the angle between the legs of said metal strip being less than 90°, the short leg being stressed outwardly to a 90° snug engagement with the door when the long leg is secured thereto;

the securing of said metal strip to said door including a series of longitudinally spaced pre-punched openings in the long leg of said strip;

fasteners projected through said openings into said door;

the securing of said wood strip to said frame including a series of longitudinally spaced transverse apertures in said strip; and fasteners extending through said apertures and into said frame;

said filler being rubber; and the interlock of said filler with said wood strip including a continuous interconnected dovetail and dovetail slot between said filler and said wood strip.

13. In the weather strip of claim 1, said door on one side being hinged within said frame; a portion of the longitudinal surface of said filler upon the hinged side of the frame adjacent the door being cut away providing a clearance angle of 6°, approximately, relative to the door edge.

14. A kit for providing the magnetic weather stripping of a door within an opening in a frame, comprising a pre-bent thin iron based resilient metal strip of general L shape in cross-section, adapted to extend along the sides and top edge of the door, with the short leg of the strip snugly engaging the door edge and with the long leg adjacent said frame extending along the inside surface of the door for securing thereto;

a wood strip of rectangular cross-section adapted for mounting upon the frame along the sides and top of the door for securing to said frame and spaced from the door;

a compressible filler of resilient plastic material mounted upon and along said wood strip and longitudinally interlocked therewith along its length, said filler adapted to extend outwardly of the frame and in compressive yielding engagement with said metal strip along its length;

an elongated magnetic strip embedded and enclosed within said compressible filler adjacent and parallel to said metal strip, with said filler adapted for sealing engagement with said door when fully closed within said opening, and with said metal strip attached to said megnetic strip;

said kit including three pre-bent metal strips with pre-punched openings along their lengths, three wood strips with assembled compression fillers and with a magnetic strip embedded in each filler, said wood strips having pre-cut longitudinally spaced openings therein, each of the respective strips being oversize in length to accommodate doors of different height and width;

and a plurality of fasteners for securing the respective strips to the door and frame.

* * * * *